US008136449B2

(12) United States Patent
Escamilla

(10) Patent No.: US 8,136,449 B2
(45) Date of Patent: Mar. 20, 2012

(54) EXPLOSIVE POWDER PLUG AND METHOD OF USING THE SAME

(76) Inventor: Peter S. Escamilla, San Antonio, TX (US)

( * ) Notice: Subject to any disclaimer, the term of this patent is extended or adjusted under 35 U.S.C. 154(b) by 24 days.

(21) Appl. No.: 12/781,031

(22) Filed: May 17, 2010

(65) Prior Publication Data

US 2011/0277656 A1 Nov. 17, 2011

(51) Int. Cl.
*F42D 3/04* (2006.01)
*F42D 1/18* (2006.01)

(52) U.S. Cl. ..... 102/304; 102/313; 102/319; 102/333; 299/13

(58) Field of Classification Search ..... 102/301, 102/304, 313, 314, 319, 321, 333; 299/13; 175/2, 4.52
See application file for complete search history.

(56) References Cited

U.S. PATENT DOCUMENTS

| | | | | |
|---|---|---|---|---|
| 351,273 | A | 10/1886 | Learnard | |
| 1,527,749 | A * | 2/1925 | Raymond | 166/153 |
| 3,039,534 | A | 6/1962 | Koop | |
| 3,188,906 | A | 6/1965 | Beck | |
| 3,362,478 | A | 1/1968 | McReynolds, Jr. | |
| 3,593,785 | A | 7/1971 | Bassani | |
| 3,952,656 | A | 4/1976 | Fox et al. | |
| 4,492,165 | A | 1/1985 | Marz | |
| 4,669,540 | A | 6/1987 | Luoma et al. | |
| 5,035,286 | A | 7/1991 | Fitzgibbon, Jr. | |
| 5,198,613 | A | 3/1993 | Jenkins, Jr. | |
| 5,497,829 | A * | 3/1996 | Rajkovich | 166/285 |
| 5,841,060 | A | 11/1998 | Skaggs | |
| 5,936,187 | A | 8/1999 | Miller et al. | |
| 6,561,270 | B1 * | 5/2003 | Budde | 166/153 |
| 6,886,466 | B2 | 5/2005 | Senules | |
| 7,052,092 | B2 | 5/2006 | Collinsworth et al. | |
| 7,331,291 | B2 * | 2/2008 | Kang | 102/303 |
| 7,387,071 | B2 | 6/2008 | Heinke et al. | |

* cited by examiner

*Primary Examiner* — James Bergin
(74) *Attorney, Agent, or Firm* — Gunn, Lee & Cave, P.C.

(57) ABSTRACT

An inexpensive bullet-shaped plug is shown for use in a blasting hole containing water in the bottom thereof, which plug permits dry powder to be used above the waterline rather than more expensive wet powder. After the blasting holes are drilled, if water accumulates in the bottom thereof, the bullet-shaped plug with a center weight is dropped into the hole, which bullet-shaped plug floats on the water. Small rocks are dropped on top of the bullet-shaped plug causing upper tentacles to flare out to engage the wall of the blasting hole. Dry powder is then loaded into the blasting hole on top of the bullet-shaped plug. A cap is inserted a distance below the surface of the blasting hole. Thereafter, a series of similar blasting holes are blown at one time to create debris that can be removed or further processed.

10 Claims, 3 Drawing Sheets

EXPLOSIVE POWDER PLUG AND METHOD OF USING THE SAME

BACKGROUND OF THE INVENTION

1. Technical Field

An explosive powder plug and method of using same is shown and, more particularly, an explosive powder plug that can be used in blasting holes having water in the bottom thereof so that dry blasting powder can be used in the blasting hole.

2. Background of the Invention

When digging into the earth's surface, hard objects such as rocks, ore, coal or other hard objects are encountered. A typical way of removing the hard object is to drill a series of boreholes (also called blasting holes) along a blast line, fill the borehole with blasting powder and blow the holes. Thereafter, the loose debris may either be removed or further processed as desired.

The problem is that many of the blasting holes drilled along the blast line may accumulate some water in the bottom thereof. The current trend in the blasting industry is if there is any water in the bottom of the blasting hole to use a wet blasting powder the entire length of the blasting hole. This is not cost efficient because wet blasting powder costs three to four times the amount of dry blasting powder.

The probability of water accumulating in the blasting hole is less in the more arid regions, but increases significantly as the rainfall for the area increases. In many blasting holes, there is only a small accumulation of water in the bottom thereof, yet wet blasting powder would be used for blowing the holes because of the water accumulation. This is especially true in mining, road construction and utility installations. Some practical way is needed so that dry powder can be used in a blasting hole that only has a small amount of water accumulated in the bottom thereof.

SUMMARY OF THE INVENTION

It is an object of the present invention to have an inexpensive plug for use in a blasting hole containing water in the bottom thereof so that dry powder may be used in the blasting hole.

It is another object of the present invention to have a method of blasting using dry powder in blasting holes that have a small amount of water accumulated in the bottom thereof.

After blasting holes are drilled along a blast line, if water has accumulated in the bottom of any of the blasting holes, a bullet-shaped plug made from two pieces of foam is dropped into the blasting hole. Assuming the blasting hole is 4 inches in diameter, then the outer diameter of the bullet-shaped plug is less than the diameter of the blasting hole. For the purposes of this example, assume the outer diameter of a foam cylinder is 3½ inches. In actual operation, some small rocks will be picked up from a drilling debris and dropped into the foam cylinder to give it weight on the lower end thereof. Thereafter, a cylindrical plug is inserted in the foam cylinder so that it is frictionally held into place because the outside diameter of the cylindrical plug is slightly larger than the inside diameter of the foam cylinder.

The upper end of the cylindrical plug has longitudinal slits therein to form upwardly extending tentacles. The bullet-shaped plug consisting of the foam cylinder and a cylindrical plug (also made out of foam) with rocks located there between is then dropped into the blasting hole. The bullet-shaped plug free-falls until it hits the water in the bottom of the blasting hole. Because of the light weight of the foam, the bullet-shaped plug will float on the surface of the water.

Thereafter, from the surface, rocks or other debris is dropped into the blasting hole. The weight of the rocks cause the tentacles to bend outward so the tentacles engage the sides of the blasting holes. Friction between the sides of the blasting hole and the tentacles hold the plug in position. Once the plug is firmly in position, dry powder is inserted in the blasting hole from immediately above the water line to just below the surface of the blasting hole which is sealed with a cap or plug. Thereafter, as desired, the line of blasting holes is blown simultaneously with the use of dry powder rather than more expensive wet powder. This results in substantial savings in explosive powder alone.

BRIEF DESCRIPTION OF THE PREFERRED EMBODIMENT

Figure 1:
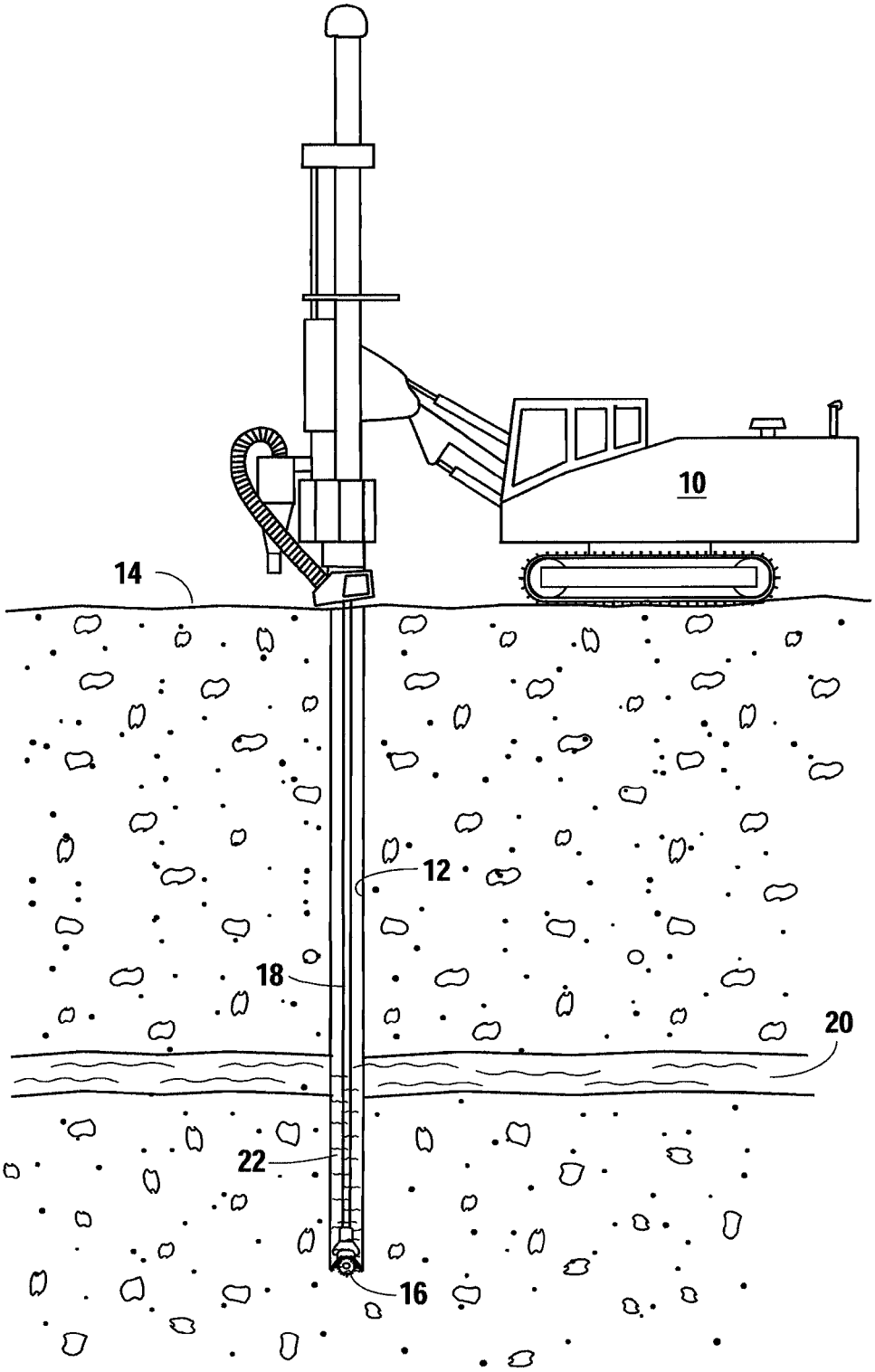
FIG. 1 is an environmental view showing a blasting hole being drilled and water accumulating in the bottom thereof.

Referring now to FIG. 1 of the drawings, a drilling rig 10 is shown drilling a bore hole 12 in the earth's crust 14. While the earth's crust 14 could be loose soil, if it is loose soil, it is normally not necessary to drill a bore hole 12, blast and then remove the debris. The earth's crust 14 could be a combination of soil and rock or could be almost entirely rock.

The embodiment shown in FIG. 1 has a tri-cone bit 16 on the end of drilling pipe 18. While the current embodiment shows a rotary-type drilling operation, many other methods of drilling the borehole 12 can be used, including auger drilling, rotary air blast drilling, air core drilling, cable drilling, reverse circulation drilling, diamond core drilling, direct push rig drilling, hydraulic-rotary drilling, sonic drilling, to name some examples.

While the embodiment shown in FIG. 1 shows the use of a tri-cone bit 16, other types of drill bits can be used including a drag bit, tapered chisel bit, tapered bottom bit, threaded cross bit, threaded bottom bit, tapered cross bit, diamond core bit, just to name of few.

In the embodiments shown in FIG. 1, a water-bearing strata 20 is shown that will cause water 22 to accumulate there below in the borehole 12. While illustrated as a water-bearing strata 20, typically, a small amount of water 22 will seep into the boreholes 12 and accumulate in the bottom of the borehole 12.

In many environments, a small amount of water 22 will accumulate in the bottom of the borehole 12. In most blasting or quarrying operations, a series of boreholes 12 are drilled along a blast line and, thereafter, the entire line of boreholes are blasted at once. For the purposes of illustration, Applicant is going to illustrate how one borehole 12 (also called "blasting hole") is set with dry blasting powder utilizing the current invention.

Assume for the purposes of illustration, the borehole 12 being drilled into the earth's crust 14 is 4 inches in diameter or greater. After the drilling of the entire row of boreholes (only one being illustrated in FIG. 1), blasting powder is added to blow the blasting hole/borehole 12. Since the borehole 12 is partially filled with water in the bottom thereof, the current trend is to use wet blasting powder which costs about four times the price of dry blasting powder.

Figure 2:
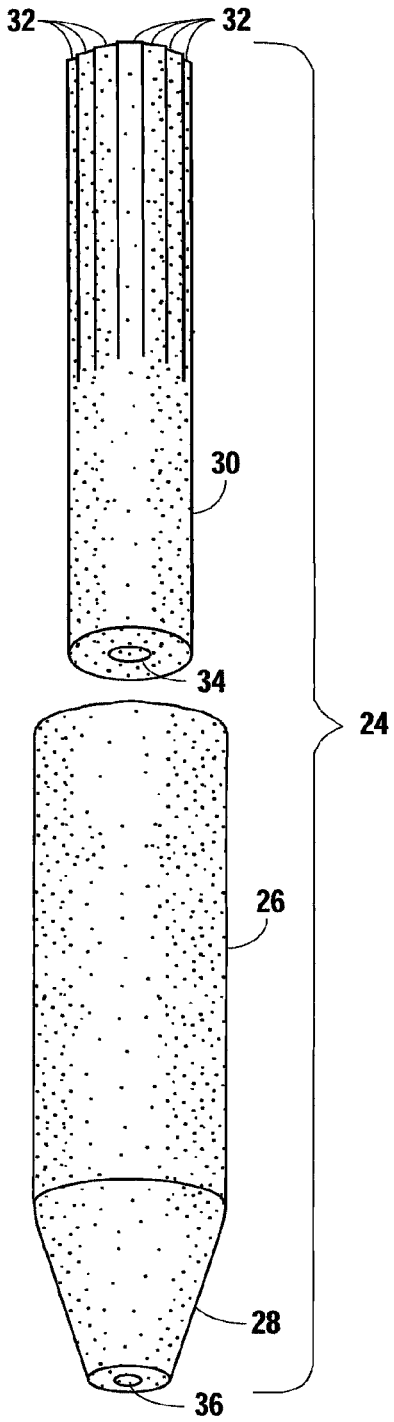
FIG. 2 is an exploded perspective view of the bullet-shaped plug.
Figure 3:
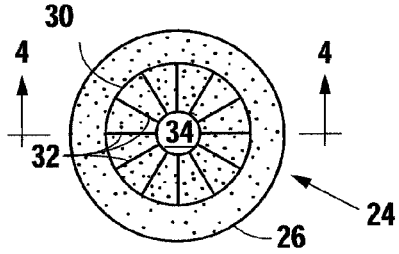
FIG. 3 is a top view of the bullet-shaped plug after being assembled.
Figure 4:
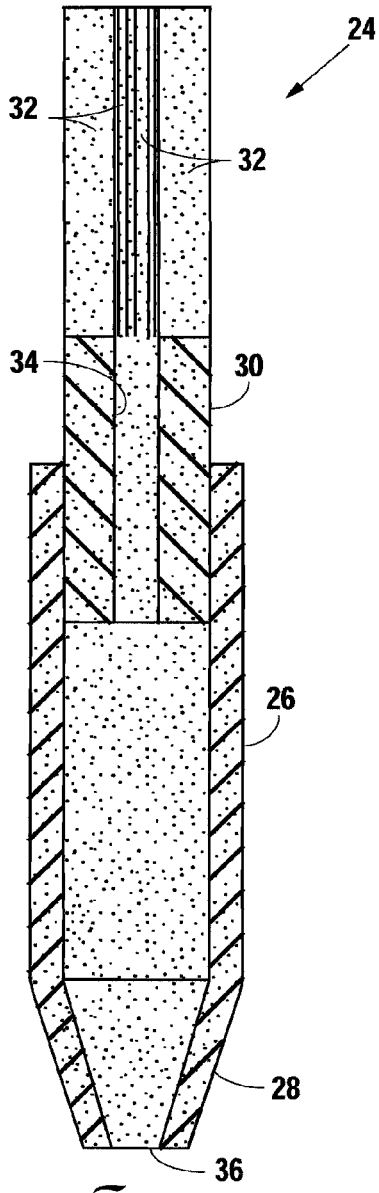
FIG. 4 is a cross-sectional view of FIG. 3 along section lines 4-4.

To use dry blasting powder and inexpensive bullet-shaped plug 24 as illustrated in FIGS. 2-4 is shown. The bullet-shaped plug 24 has a lower cylinder portion 26 that has an outside diameter of approximately 3½ inches. The lower cylinder portion 26 terminates into a lower cone 28. Both the lower cylinder portion 26 and the lower cone 28 are made from an inexpensive foam material.

A cylindrical plug 30 has an outside diameter slightly larger than the inside diameter of the lower cylinder portion 26 so there is a frictional bond there between when inserted in position as shown in FIG. 4. The upper portion of the cylindrical plug 30 has longitudinal slits cut therein for over half the length of the cylindrical plug 30. The cylindrical plug 30, including the area having the longitudinal slits 32 therein has a cylindrical bore 34 there through. Also, the lower end of the lower cone 28 has a lower opening 36 therein.

Figures 5, 6, 7, 8:
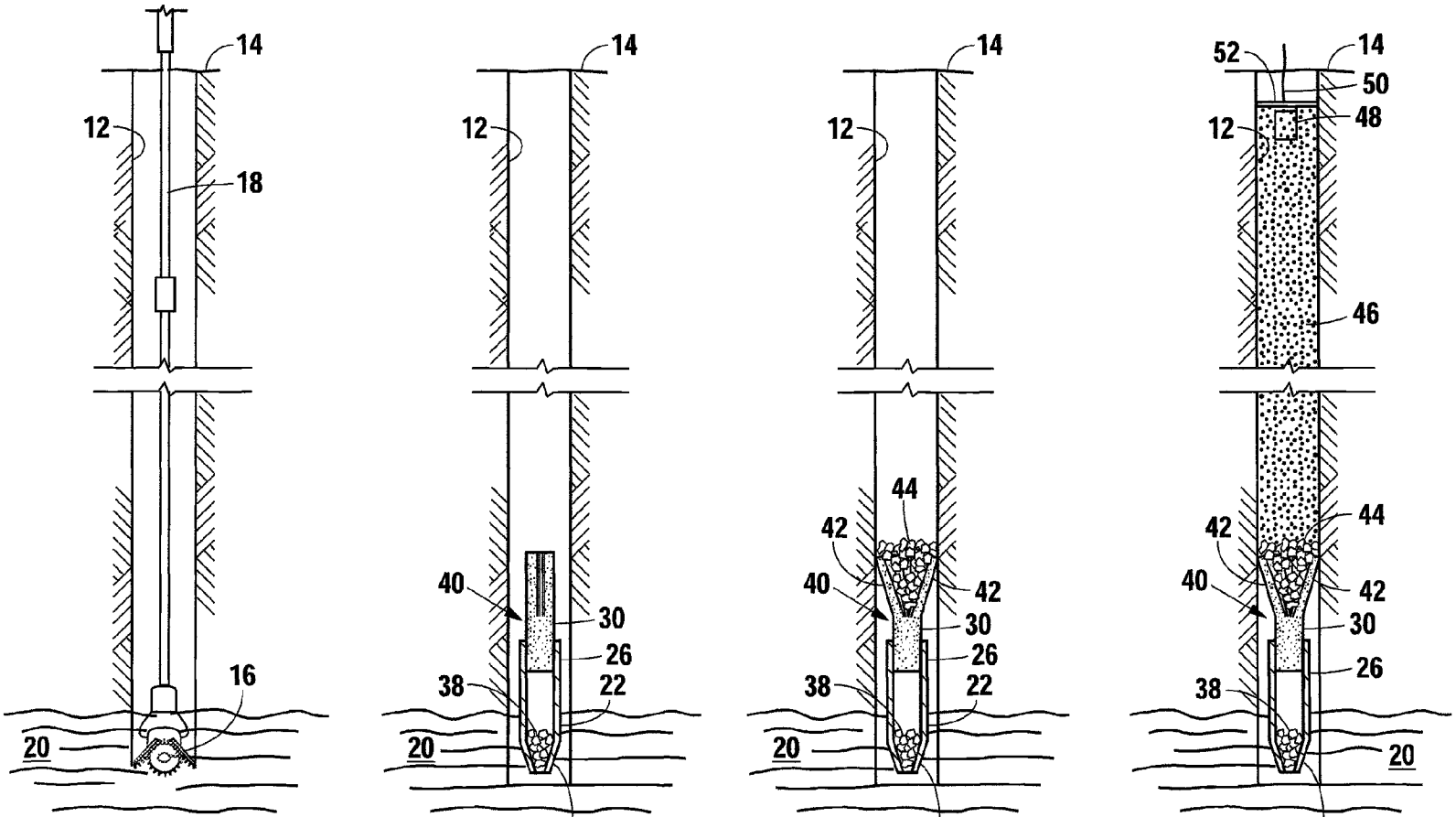
FIG. 5 is a cross-sectional sequential view showing a blasting hole being drilled into water bearing formation.
FIG. 6 is a sequential view showing water accumulation in the blasting hole and the bullet-shaped plug being dropped therein.
FIG. 7 is a sequential view showing the tentacles of the bullet-shaped plug being expanded to frictionally engage the sides of the blasting hole.
FIG. 8 is a sequential view showing dry blasting powder being inserted in the blasting hole above the bullet-shaped plug, a detonator inserted and the blasting hole sealed.

Referring now to FIGS. 5-8, after the borehole or blasting hole 12 is drilled in the earth's crust 14 by the tri-cone bit 16 attached to a drilling pipe 18, water 22 will accumulate in the borehole 12 below the water-bearing strata 20. In FIG. 6, the drilling pipe 18 and the tri-cone bit 16 have been removed. A person on the surface will take the lower cylinder portion 26 and drop small rocks 38 in the bottom thereof which will lodge against the lower cone 28. The small rocks 38 are readily available on the surface from the drilling debris. Thereafter, the cylindrical plug 30 is inserted into the lower cylinder portion 26 and the entire bullet-shaped plug 40 is dropped into the borehole/blasting hole 12. (See FIG. 6.) Because the bullet-shaped plug 40 is made from very lightweight foam, the small rocks 38 gives the bullet-shaped plug 40 sufficient weight so that it will drop down the borehole 12 until it hits water 22. However, the bullet-shaped plug 40 even with the small rocks 38 will float in the water 22. Thereafter, additional rocks 44 are dropped into the borehole 12, which additional rocks hit the top of the cylindrical plug 30 causing upper tentacles 42, formed by the longitudinal slots 32 in the cylindrical plug 30 to flare outward and engage the inner wall of the borehole 12. The additional rocks 44 accumulate with the upper tentacles 42 being pushed outward as is illustrated in FIG. 7.

After the bullet-shaped plug 40 is securely in position with the upper tentacles 42 frictionally engaging the inside of the borehole 12, dry blasting powder 46 is used to fill the borehole/blasting hole 12 in the area above the bullet-shaped plug 40. In the dry blasting powder 46 is located a detonator 48 which is connected by a wire 50 to a energy source (not shown). To keep the blast from going upwards, a cap or plug 52 is used to seal the upper part of the borehole/blasting hole 12.

While the present invention would probably not be used in blasting holes filled or almost filled with water, it can be used in blasting holes having a small amount of water accumulation in the bottom thereof. In those cases, inexpensive dry blasting powder could be used versus the much more expensive wet blasting powder. The bullet-shaped plug 40 including the lower cylinder portion 26, lower cone 28, cylindrical plug 30 and the upper tentacles 42 are all made from inexpensive and lightweight foam. The foam needs to be flexible so the upper tentacles 42 will flare out as shown in FIG. 7 when additional rocks 44 are dropped thereon.

The diameter of the bullet-shaped plug 40 can be either increased or decreased as necessary to fit the diameter of the borehole/blasting hole 12. Also, the type of foam being used to form the bullet-shaped plug 40 can be varied as necessary.

What I claim is:

1. A method of using dry blasting powder in a blasting hole having water in the bottom thereof comprising the following steps:

drilling said blasting hole, said water accumulating in said bottom of said blasting hole;

inserting weight in a lower cylinder portion of a bullet-shaped plug, said bullet-shaped plug having a cone on a lower end thereof;

plugging a top of said lower cylinder portion of said bullet-shaped plug with a cylindrical plug, said cylindrical plug having upper tentacles attached thereto;

dropping said lower cylinder portion of said bullet-shaped plug and said cylindrical plug into said blasting hole, said lower cylinder portion of said bullet-shaped plug and said cylindrical plug being lightweight to float on said water even with said weight;

dropping of rocks into said blasting hole on top of said upper tentacles to cause said upper tentacles to flare outward and frictionally engage said blasting hole so that the top of said rocks remain above said water;

loading on said top of said rocks said blasting hole with said dry blasting powder and a detonator s; and blowing said detonator and said dry blasting powder in said blasting hole.

2. The method of using dry powder in a blasting hole having water in the bottom thereof as recited in claim 1, wherein said upper tentacles are found by longitudinal slits in a top of said cylindrical plug.

3. The method of using dry powder in a blasting hole having water in the bottom thereof as recited in claim 2, wherein said weight in said lower cylinder portion is small stones.

4. The method of using dry powder in a blasting hole having water in the bottom thereof as recited in claim 3, wherein after said loading step a cap is secured in said blasting hole above said dry blasting powder to keep blast force from said blowing step from going upward.

5. The method of using dry powder in a blasting hole having water in the bottom thereof as recited in claim 4, wherein a series of said blasting holes are drilled with said inserting, plugging, first dropping, second dropping and loading steps being repeated for each of said series of said blasting holes, said blowing step being simultaneous for said series of said blasting holes.

6. A blasting plug for using dry blasting powder in a borehole having water in a bottom thereof when said borehole is drilled into the earth's crust producing stones and rocks, said blasting plug comprising:

a lower cylinder portion having an inside diameter and an outside diameter, said outside diameter being less than an inside diameter of said borehole;

an inverted cone forming at a bottom of said lower cylinder portion;

an cylindrical plug having an outside diameter slightly larger than said inside diameter of said lower cylinder portion for a snug frictional fit there between;

longitudinal slits cut in an upper portion of said cylindrical plug to form upper tentacles;

said lower cylinder portion and said cylindrical plug being lighter than water;

said stones are inserted in said lower cylinder portion below said cylindrical plug to cause said blasting plug to fall in said borehole;

said rocks are dropped in said borehole on top of said blasting plug to cause said upper tentacles to frictionally engage said borehole so that the top of said rocks in said borehole remains above the top of said water before inserting there above said dry blasting powder and blowing said borehole.

7. The blasting plug for using dry powder in a borehole having water in the bottom thereof as recited in Claim 6, wherein said blasting plug is made from foam.

8. The blasting plug for using dry powder in a borehole having water in the bottom thereof as recited in claim 7, wherein said lower cylinder portion and said inverted cone are one piece.

9. The blasting plug for using dry powder in a borehole having water in the bottom thereof as recited in claim 8, wherein said cylindrical plug has a longitudinal hole running through a center thereof.

10. The blasting plug for using dry powder in a borehole having water in the bottom thereof as recited in claim 9, wherein said inverted cone has a center opening therein.

* * * * *